US006392177B1

(12) United States Patent
Zhang et al.

(10) Patent No.: US 6,392,177 B1
(45) Date of Patent: May 21, 2002

(54) TACT SWITCH CONNECTOR

(75) Inventors: Jian Quiang Zhang; Jin Song Tian, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/949,218

(22) Filed: Sep. 7, 2001

(51) Int. Cl.[7] ..... H01H 1/10
(52) U.S. Cl. ..... 200/406; 200/550
(58) Field of Search ..... 200/16 R–16 D, 200/405–409, 447, 449, 453, 520, 522, 517, 341, 533, 551, 275, 547, 549, 550

(56) References Cited

U.S. PATENT DOCUMENTS 4,405,845 A * 9/1983 Kondo et al. ..... 200/283
5,660,272 A * 8/1997 Janniere et al. ..... 200/517
6,018,132 A * 1/2000 Chen ..... 200/406
6,114,644 A * 9/2000 Nishikawa ..... 200/406
6,180,903 B1 * 1/2001 Chen ..... 200/406
6,262,383 B1 * 7/2001 Nishikawa ..... 200/406
6,323,449 B1 * 11/2001 Janniere ..... 200/317

* cited by examiner

*Primary Examiner*—Michael Friedhofer
(74) *Attorney, Agent, or Firm*—Wei Te Chung

(57) ABSTRACT

A tact switch connector (1) includes a housing (6), a metal dome (5), a metal cover (2), a plurality of contacts (63), a pusher (3) and a spring (36). The housing has a base (61) and two sidewalls (62). The metal dome is positioned on the base of the housing. The plurality of contacts are retained in the housing. The metal cover has a plate (21) and a curved lever (24) extending under the plate for pressing against the metal dome. The pusher has a body (31) and a groove (341) in the body. The body has two side faces and each side face has a plurality of notches (342). The spring is assembled in the groove and has a plurality of bent portions (361 and 362) situated in the notches for contacting with the contacts.

9 Claims, 6 Drawing Sheets

TACT SWITCH CONNECTOR

FIELD OF THE INVENTION

The present invention relates to a tact switch connector, especially to a tact switch connector which needs a manual depression and the depression can produce electrical connection between a plurality of separate contacts.

BACKGROUND OF THE INVENTION

Switches which have quick response to a manual depression have been used in many appliances such as in telephone sets, remote controls, TV sets etc. Such a conventional tact switch connector is disclosed in U.S. Pat. Nos. 6,018,132 and 6,180,903 which concern horizontal tact switch connectors. Referring to FIG. 9 derived from the aforementioned U.S. Pat. No. 6,018,132, the conventional connector comprises a housing, a plurality of contacts retained at the bottom of the housing, a metal cover assembled on the housing and having a lever, a pusher having a ramp for displacing the lever, a metal dome having an upper central area, a plate assembled in the housing and having a plurality of spring arms each having a bent end. When the pusher is pressed, the ramp of the pusher actuates the lever of the metal cover, and the lever moves downwardly to actuate the metal dome to press the spring arm, thereby forcing the bent ends to contact with the contacts respectively. When the pusher is released, the bent ends move away from the contacts, and the metal dome springs back to move the lever of the metal cover upwardly, thereby actuating the pusher back to its normal position. The operation of the tact switch connector depends on the flexibility of the spring arm and the bent ends of the plate. The present invention is an improvement to the above invention to increase the reliability of the tact switch.

SUMMARY OF THE INVENTION

Accordingly, the primary object of the present invention is to provide a tact switch connector having a plurality of contacts for sidewardly contacting a spring element disposed on a slidable pusher of the tact switch.

A tact switch connector according to the present invention includes a housing, a metal dome, a metal cover, a plurality of contacts, a pusher and a spring. The housing has a base and two sidewalls. The metal dome is positioned on the base of the housing. The plurality of contacts is retained in the housing. The metal cover has a plate and a curved lever extending under the plate for pressing against the metal dome. The pusher has a body and a groove in the body. The body has two side faces and each side face has a plurality of notches. The spring is assembled in the groove and has a plurality of bent portions situated in the notches for contacting with the contacts.

Other objects, advantages and novel features of the invention will become more apparent from the following detailed description when taken in conjunction with the accompanying drawings.

DETAILED DESCRIPTION OF THE INVENTION

Figure 1:
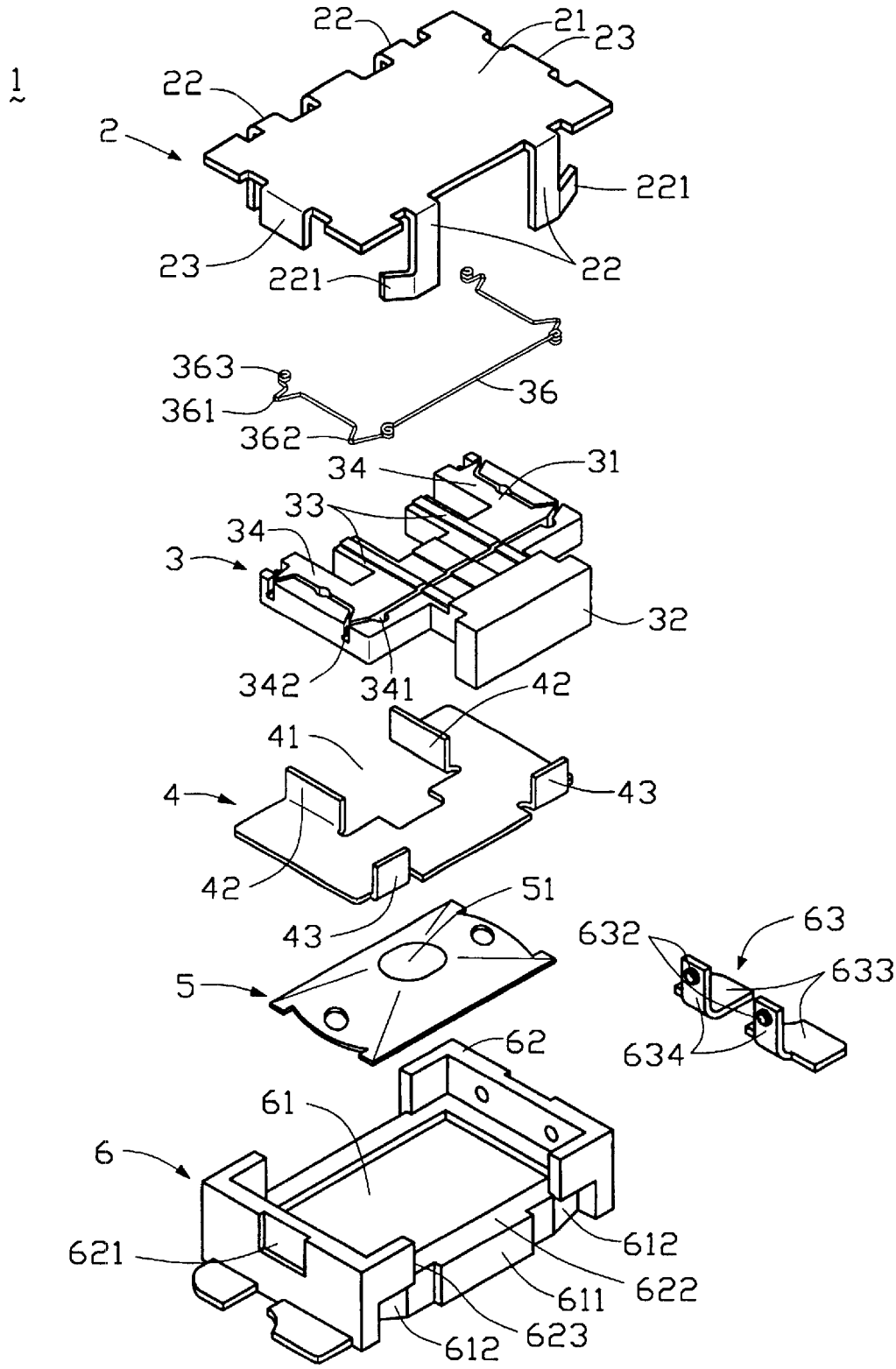
FIG. 1 is an exploded view of a tact switch connector in accordance with the present invention.
Figure 2:
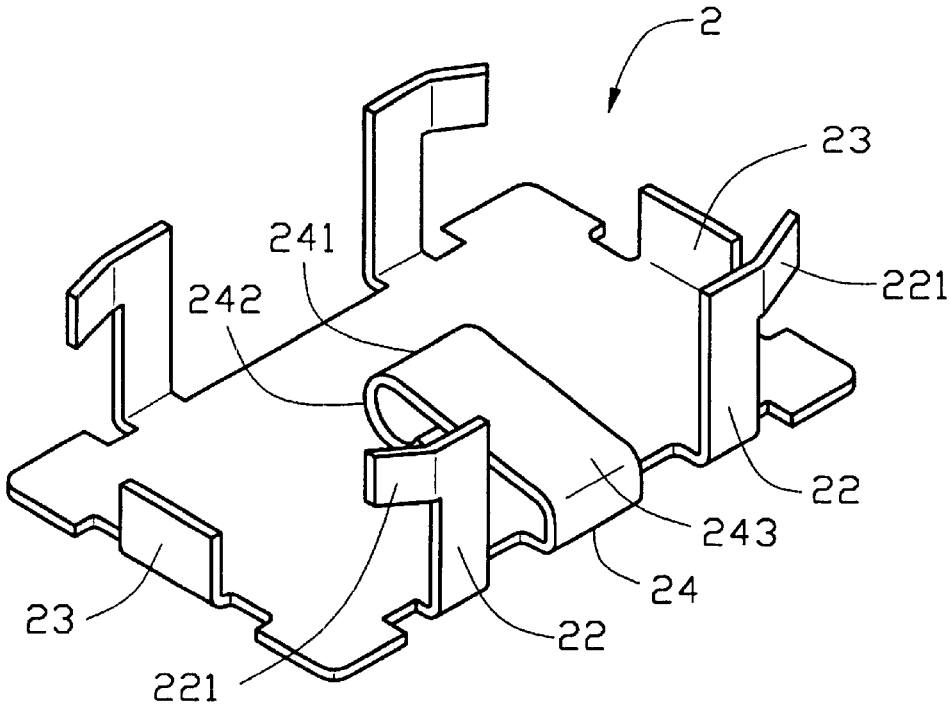
FIG. 2 is a bottom perspective view of a metal cover shown in FIG. 1.
Figure 3:
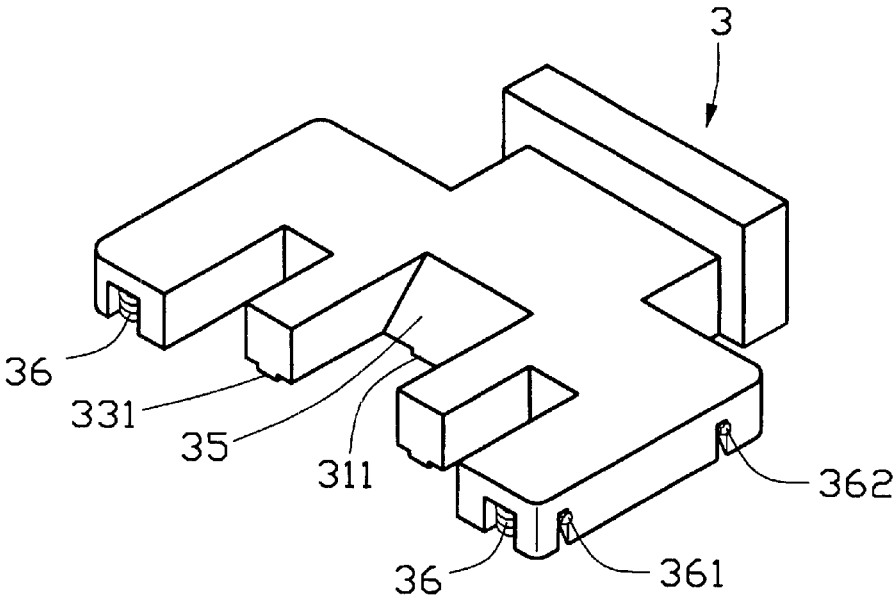
FIG. 3 is a perspective view of a pusher shown in FIG. 1.

Referring to FIGS. 1 and 2, a tact switch connector 1 in accordance with the present invention comprises a metal cover 2, a pusher 3, a spring(conductive member) 36 carried by the pusher 3, a metal dome 5, a housing 6, and a plurality of contacts 63 mounted to the housing 6. The metal cover 2 defines a rectangular plate 21. Four tangs 22 extend downward from front and rear edges of the rectangular plate 21 and two tabs 23 extend downward from side edges of the rectangular plate 21, wherein the tangs 22 extending from the front edge of the rectangular plate 21 are spaced from each other with a predetermined distance. Each tang 22 has a bent end 221 extending from one end thereof. A lever 24 extending from the rear edge of the plate 21 includes an upper contacting portion 242 proximate to the plate 21 and a lower depressing portion 243 defined adjacent to a curved end 241 thereof.

Figure 7:
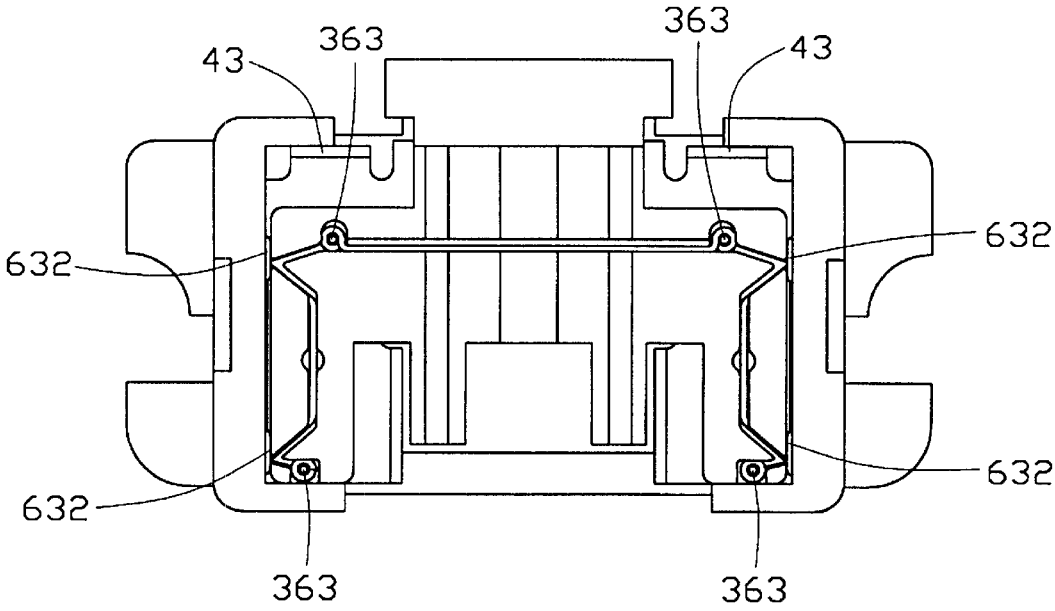
FIG. 7 is a view similar to FIG. 5, showing the pusher being pressed.

Referring to FIGS. 1 and 7, the pusher 3 has a T-shaped body 31, a touch pad 32 integrated with a neck portion of the T-shaped body 31, a pair of outer fingers 34 and a pair of inner fingers 33 extending horizontally from a wide rear edge of the T-shaped body 31, wherein a ramp 35 is formed in a middle portion of the rear edge between the inner fingers 33. A U-shaped groove 341 is defined on the outer fingers 34 and the body 31. Four notches 342 are formed at the sidewalls of the outer fingers 34. The outer fingers 34 are longer than the inner fingers 33. Rails 331 and 311 are respectively formed on the top surfaces of the inner fingers 33 and the T-shaped body 31. A U-shaped spring 36 having two pairs of bent(engaging) portions 361 and 362 is assembled on the U-shaped groove 341 by two pairs of position poles 363, and the four bent portions 361 are in the four notches 342.

A supporting plate 4 made from a metal plate may be provided under the pusher 3. The plate 4 has a cutout 41 at a rear edge thereof. A pair of first tabs 42 extends upward from and is positioned close to the outer space 34 for guiding the movement of the pusher 3. A pair of second tabs 43 extend upward from a front edge of the supporting plate 4. The metal dome 5 has a rectangular upper central area 51.

The housing 6 has a base 61 and two U-shaped sidewalls 62 commonly defining a space therein. Four contacts 63 are embedded in the U-shaped sidewalls 62 by insert molding. Each contact 63 comprises a soldering portion 633, a connecting portion 634 extending perpendicular to the soldering portion 633 and a contacting portion 632. The four soldering portions 633 of the contacts 63 expose to outside from the bottom surface (not labeled of the housing 6). The base 61 has a peripheral wall defining a cavity (not labeled). The peripheral wall 611 has an upper surface 622. The two U-shaped sidewalls 62 extent upward from the periphery wall 61 and define a front entrance 623 and a rear entrance (not labeled) therebetween. Four shallow portions 612 are defined in front and rear sides of the periphery wall 61 for engagement with the bent ends 221 of the tangs 22 of the metal cover 2. Two grooves 621 are formed in opposite sides of the U-shaped sidewalls 62 for engagement with the tabs 23 of the metal cover 2.

Figure 4:
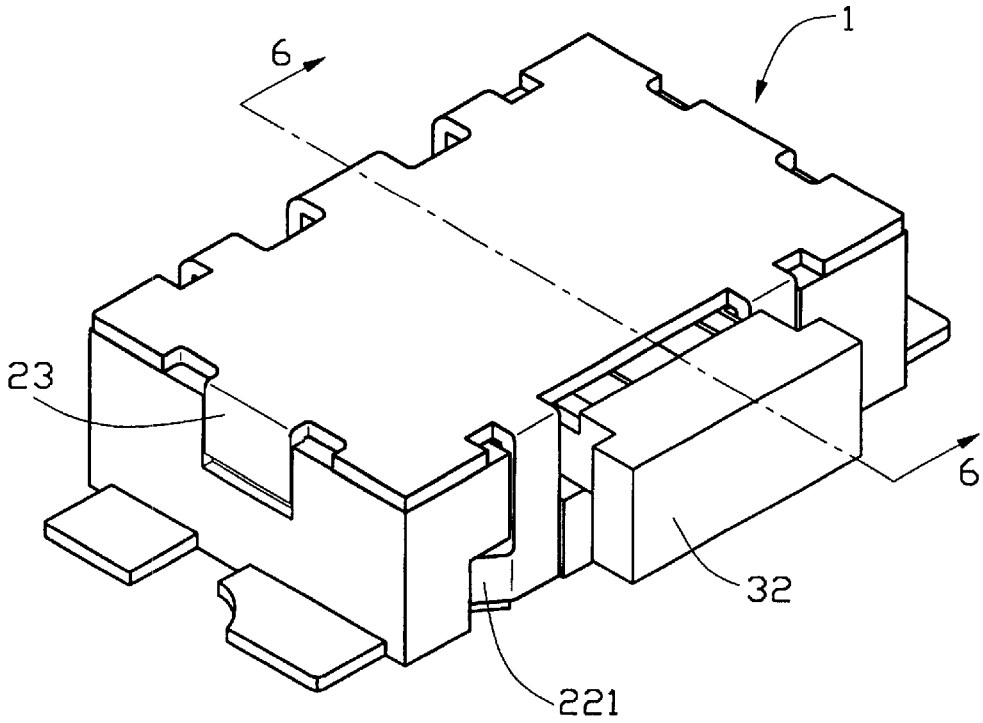
FIG. 4 is an assembled view of FIG. 1.
Figure 5:
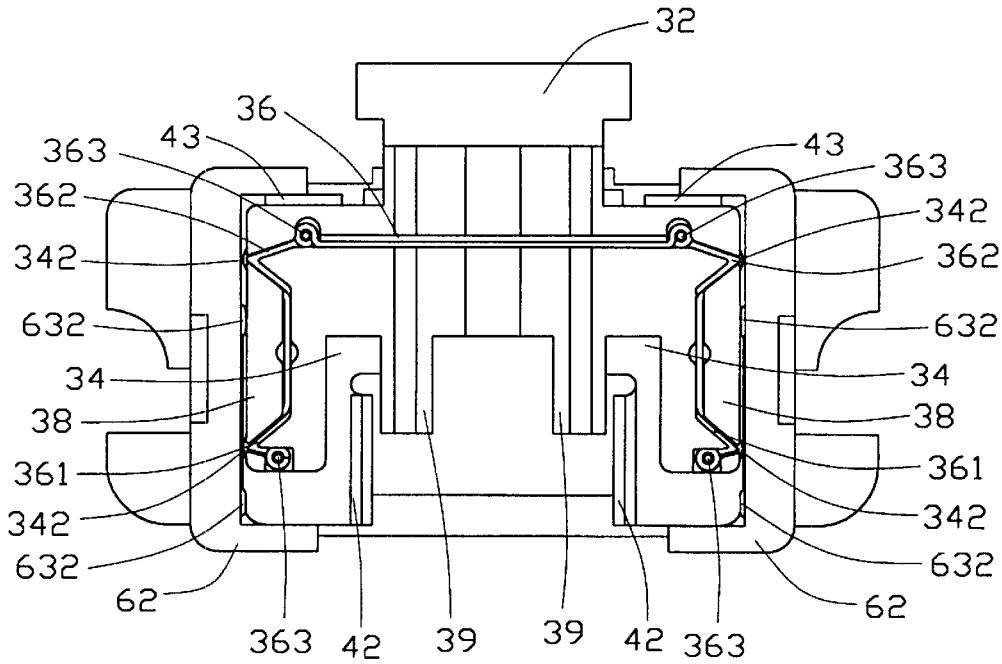
FIG. 5 is a top view of FIG. 4 with the metal cover removed for clarity, showing the pusher not being pressed.

In assembly, particularly referring to FIG. 4, the two pairs of contacts 63 are assembled on the U-shaped sidewalls 62. The metal dome 5 is positioned on the base 61 of the housing 6. The supporting plate 4 is positioned on the upper surface 622, with the second tabs 43, the side edge, and the rear edge thereof being retained between inner surfaces of the U-shaped sidewalls 62. The pusher 3 is positioned on the supporting plate 4, with the first tabs 42 of the supporting plate 4 being at outer sides of the inner fingers 33. Finally, the metal cover 2 is assembly onto the housing 6 by engaging the bent ends 221 of the tangs 22 within the shallow portion 612 of the periphery wall 611, and engaging the tabs 23 thereof with the grooves 621 of the periphery wall 611, while the upper contacting portion 242 of the lever 24 abuts against the ramp 35 of the pusher 3, and the lower depressing portion 243 of the lever 24 extends through the cutout 41 of the supporting plate 4. The rails 331 formed on the top surface of the pusher 3 contact with the metal cover 2 for facilitating movement of the pusher 3 under the metal cover 2 when the pusher 3 is depressed.

Figure 6:
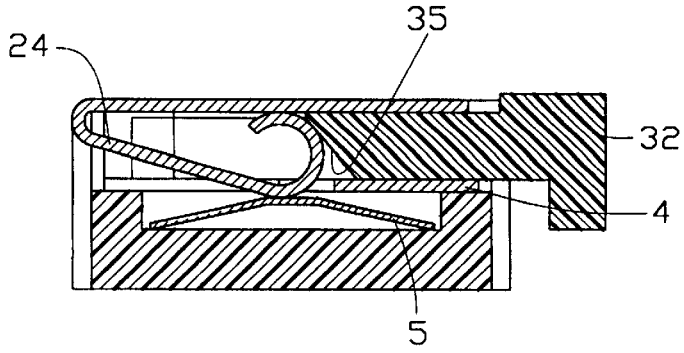
FIG. 6 is a cross-sectional view taken along line 6—6 of FIG. 4.
Figure 8:
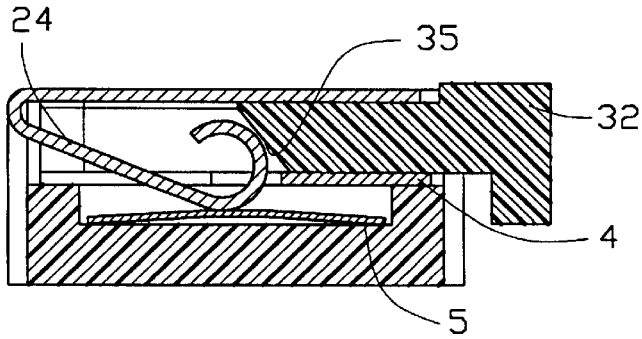
FIG. 8 is a view similar to FIG. 6 but showing the pusher being pressed.
Figure 9:
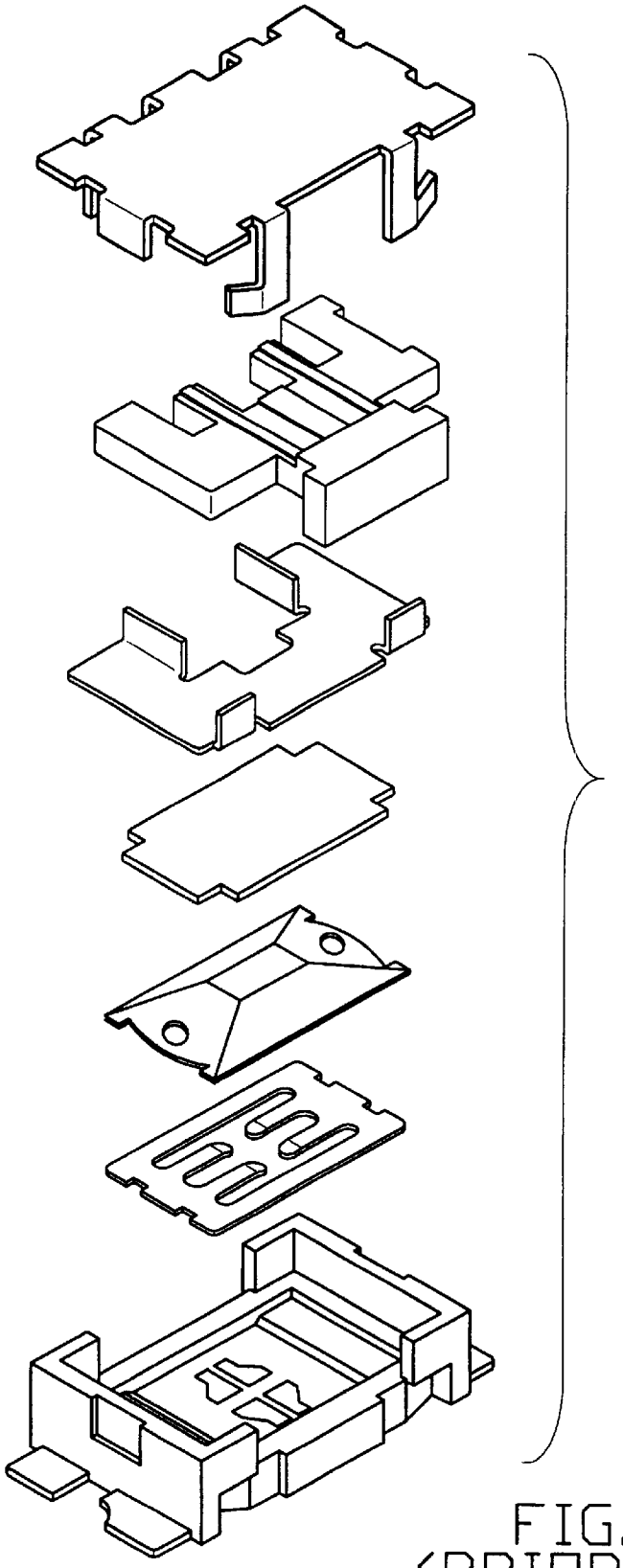
FIG. 9 (PRIOR ART)
FIG. 9 is an exploded view of a conventional connector.

Referring to FIGS. 6 and 8, during operation, the pusher 3 is pressed horizontally by a user until the outer fingers 34 thereof abuts against the U-shaped sidewalls 62 of the housing 6. Under the depression of the pusher 3, the ramp 35 moves forward to drive the lever 24 of the metal cover 2 thereby forcing the lower pressing portion 243 of the lever 24 to depress the metal dome 5. With the movement of the pusher 3, the U-shaped spring 36 moves and the bent portions 361 and 362 move from the notches 342 to the contacting portions 632 of the contacts 63 embedded in the U-shaped sidewalls 62. Thus the U-shaped spring 36 electrically connects to the contacting portion 632 of the contacts 63 simultaneously. At the same time, the upper contacting portion 242 of the lever 24 forces the metal dome 5 to move downwardly.

When the depression on the pusher 3 is released, the metal dome 5 go back again, the upper contacting portion 242 of the lever 24 moves the ramp 35 of the pusher 3, and the pusher 3 retreats from the base 61 of the housing 6. The bent portions 361 move from the contacting portion 632 to the two notches 342, and the other pair of bent portions 362 move from the other pair of the contacting portion 632 to the other pair of notches 342, thus the U-shaped spring 36 electrically disconnect from the contacting portion 632 of the contact 63 simultaneously.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A tact switch connector comprising:

a housing having a base and two sidewalls;

a metal dome being positioned on the base of the housing;

a plurality of contacts being retained in the housing;

a metal cover having a plate and a curved lever extending under the plate for pressing against the metal dome;

a pusher having a body and a groove in the body, the body having two side faces and each side face having a plurality of notches; and a spring assembled in the groove and having a plurality of bent portions situated in the notches for contacting with the contacts.

2. The tact switch connector in accordance with claim 1, wherein the pusher comprises a plurality of position poles in the groove for positioning the spring.

3. The tact switch connector in accordance with claim 1, wherein the body of the pusher has a ramp for displacing the lever of the metal cover.

4. The tact switch connector in accordance with claim 1, wherein the contacts are retained in the sidewalls of the housing.

5. The tact switch connector in accordance with claim 1, wherein each of the contacts comprises a soldering portion and a connecting portion vertical to the soldering portion, and the connecting portion defines a contacting portion.

6. The tact switch connector in accordance with claim 5, wherein the bent portions are movable with the pusher to electrically contact with the contacting portions of the contacts.

7. A tact switch connector comprising:

a housing having a base and at least one side wall;

a plurality of contacts retained in the housing with contacting portions, around the least one side wall;

a cover mounted on the housing, said metal cover including a plate with a curved lever extending therefrom;

a pusher horizontally slidably mounted in the housing between the base of the housing and the plate of the cover, said pusher including thereof a ramp confronting the curved lever; and a conductive member carried by the pusher and defining a plurality of engaging portions respectively corresponding to and in a same horizontal plane with the contacting portions of the contacts; wherein in an "ON" status, the pusher is in a first horizontal position where the ramp of the pusher and the curved lever of the cover are in a "loose" confrontation manner, the curved lever of the cover is not significantly deflected in a vertical direction, and the engaging portions of the conductive member and the contacting portion of the contacts are not correspondingly mechanically and electrically connected to each other; in an "OFF" status, the pusher is in a second horizontal position wherein the ramp of the pusher and the curved lever of the cover are in a "tight" confrontation manner, the curved lever of the cover is significantly deflected in the vertical direction with restoration forces generated thereof, and the engaging portions of the conductive member are horizontally moved to engage the contacting portions of the corresponding contacts, respectively.

8. The connector in accordance with claim 7, wherein a flexible dome is positioned in the housing and engageably positioned below the curved lever for auxiliary support to the curved lever.

9. A tact switch connector comprising:

an insulative housing defining at least a side wall thereof and a space therein;

a plurality of contacts disposed in the housing with contact portions exposed around the side wall;

a cover mounted on the housing;

a pusher horizontally slidably positioned in the space;

a conductive member moved along with the pusher in a horizontal direction;

a plurality of engaging portions formed on the conductive member respectively corresponding to and in a same horizontal plane with said contact portions of the contacts;

a curved lever located in front of a distal end of the pusher; wherein when the pusher is manually horizontally pushed into an inner position, the curved lever is deflected in a vertical direction to generate a restoration force and the engaging portions of the conductive member move horizontally, and mechanically and electrically engage the corresponding contacting portions of the contacts, respectively; when the pusher is manually released, the curved lever resumes its original vertical position by said restoration force and urges pusher to move horizontally in an opposite direction toward an outer position for disengaging the engaging portions of the conductive member from the corresponding contacting portions of the contacts, respectively.

* * * * *